United States Patent [19]

Buchner

[11] Patent Number: 4,593,621

[45] Date of Patent: Jun. 10, 1986

[54] CARTRIDGE ASSEMBLY

[76] Inventor: Delmer B. Buchner, 16 Dubois Rd., Warren, N.J. 07060

[21] Appl. No.: 773,644

[22] Filed: Sep. 9, 1985

Related U.S. Application Data

[62] Division of Ser. No. 651,299, Sep. 17, 1984, Pat. No. 4,565,131.

[51] Int. Cl.[4] ..... F42B 5/02; F42B 8/00; F42B 5/30

[52] U.S. Cl. ..... 102/430; 102/444; 102/466; 102/501; 102/514

[58] Field of Search ..... 102/430, 444, 464, 466, 102/467, 501, 511, 514, 435

[56] References Cited

U.S. PATENT DOCUMENTS

| | | | |
|---|---|---|---|
| 2,654,319 | 10/1953 | Roske . | |
| 2,862,446 | 12/1958 | Ringdal . | |
| 2,918,868 | 12/1959 | Ringdal . | |
| 3,144,827 | 8/1964 | Boutwell . | |
| 3,678,858 | 7/1972 | Herter et al. | 102/466 |
| 3,722,412 | 3/1973 | Herter | 102/466 |
| 3,874,294 | 4/1975 | Hale | 102/467 |
| 3,882,778 | 5/1975 | Gawlick . | |
| 3,935,816 | 2/1976 | Baquette . | |
| 4,147,107 | 4/1979 | Rindal . | |
| 4,328,750 | 5/1982 | Oberg et al. | 102/514 |

*Primary Examiner*—Harold J. Tudor
*Attorney, Agent, or Firm*—William T. Hough

[57] ABSTRACT

In a preferred embodiment, a cartridge assembly of a cartridge base of compressed polycarbonate, polyethylene and Teflon having at a forward end thereof a circumscribing annular flange mounted in a circumscribing annular recess within an inner wall surface of an open end of a plastic envelope of high-density polyethylene of which a distal-end of the plastic envelope has thin weakened walls extending along longitudinally-extending lines or of which a distal-end of the plastic envelope has mounted therein a slug (ball or bullet) of metal.

5 Claims, 4 Drawing Figures

CARTRIDGE ASSEMBLY

This application is a divisional application of 651,299 filed on Sept. 17, 1984 now U.S. Pat. No. 4,565,131.

This invention is directed to an improved cartridge assembly as a cartridge blank, a cartridge plastic-bullet assembly and/or a cartridge metal-bullet assembly.

BACKGROUND TO THE INVENTION

Prior to the present invention, efforts have been made to produce cartridge blanks typically for the military firearms such as M1, M2 and the like, which will remain stable and fireable over prolonged periods of shelf-life. However, prior to the present invention there has been no outstanding success in such achievement, as a result of differences in the coefficient of expansion in the cartridge and the open-end of the shell mounted thereon, moisture making its way inevitably into the envelope space such that the cartridge assembly often will not fire after shelf life of varying lengths of time, thus being totally unreliable. The military uses large quantities of such blanks and has found such difficulties and problems very frustrating in and for their training excercises. Until the present invention, the above-noted problems have appeared to defy solution.

OBJECTS OF THE INVENTION

Accordingly, a major object of the present invention is to obtain a cartridge assembly overcoming problems and difficulties of the nature discussed above, together with the obtaining of other novel advantages and assemblages.

Another object is to obtain a novel cartridge-base adapted to overcome problems above-noted with prior cartridge assemblies utilizing plastic envelopes.

Another object is to obtain a novel combination of a novel cartridge-base assembled with a particular type of platic in envelope shape as a cartridge assembly utilizable as either and each of a cartridge blank, a plastic-bullet assembly, and/or a metal-bullet assembly, or the like.

Another object is to obtain a novel cartridge-base sufficiently sturdy to withstand the explosion of firing the cartridge assembly utilizing the same as the cartridge-base of a blank and/or a plastic-bullet assembly and/or a metal-bullet assembly.

Another object is to obtain a novel cartridge assembly sufficiently sturdy in each of envelope and cartridge-base as to withstand forces of explosion upon the firing thereof, while being mateable and sealable over prolonged periods of time sufficient to prevent influx of moisture that destroys its ability to be fired.

Other objects become apparent from the preceding and following disclosure.

One or more objects are achieved by the invention as setforth in the following described and claimed invention as typically represented by the accompanying drawings intended to improve understanding but to not unduly limit the invention by the merely illustrative examples.

SUMMARY OF THE INVENTION

Broadly the invention may be described as at-least a cartridge-base comprising a major amount of each of at-least polycarbonate and polyethylene in admixture (admixed) and in a state of compressed-mixture (compressed as a unit) in the shape of a cartridge-base.

In a preferred embodiment there is also included a minor amount of Teflon in an amount sufficient to provide at-least a minimal degree of lubricicity, providing for improved sealing during contraction and expansion of adjacent surfaces of the cartridge-base and the mounting-portion of the envelope of the cartridge assembly. Teflon is a Trademark name for polytetrafluoroethylene.

In a preferred cartridge assembly, in combination with the above-noted inventive cartridge-base, there is a plastic envelope of polyethylene, preferably high-density polyethylene critically necessary to achieve a durable envelope sufficient to be reliable, the envelope mounted on the cartridge-base of the nature described-above.

In another preferred embodiment, the envelope above-described as a part of the above-noted novel combination, includes at-least a pair of lines of reduced wall-thickness extending longitudinally from the envelope's forward distal end toward the open-end of the envelop for a portion of the length of the envelope up to about one-fifth or one-sixth its length preferably, thereby producing a blank susceptible of rupture during explosion of the charge within the envelope upon the firing of the primer of conventional design.

As an alternative, another novel combination results from the distal end of the envelope being of a major portion of solid plastic preferably with an annular ring of reduced wall-thickness at a base of the distal-end solid plastic such that during explosion the solid plastic becomes torn-loose and projected as a plastic bullet. In an alternative other embodiment, the envelope may have its upper distal-end walls of sufficiently thin plastic and have mounted therein at its upper distal end within space thereof, a slug (bullet or ball) of either plastic or metal that becomes propelled through the barrel of the gun or rifle or piece upon the firing of the cartridge assembly charge by a conventional primer when fired in the gun, rifle or piece. These are preferred embodiments In another preferred embodiment of the cartridge assembly, a forward end of the cartridge-base has a circumscribing annular flange mounted in a circumscribing annular recess within an inner wall surface of an open end of the plastic envelope of the high-density polyethylene or other polyethylene as the case may be, as a key-lock of the envelope onto the cartridge-base, apart from the use of conventional adhesive or glue, such as for example Loctite 430 (Trademark) which is conventionally used in adhering a cartridge- assembly envelope to a cartridge-assembly cartridge-base, and may likewise be also utilized in the combination-assemblies of this invention. From the preceding background discussion, it should be noted that the water-tight (moisture-tight) seal has in the past proven to be satisfactory except for ruptures over prolonged periods of storage (shelf-life) during which repeated subjection to changes in temperature resulted in rupture of such seal(s) as a result of differing coefficients of expansion of the mating-surfaces, at least in part as presently understood. However, the inventor's recognition of this was not alone sufficient to ascertain which adjacent compositions of cartridge-base and envelope would prevent such ruptures, the inventor having been compelled to do extensive research of many differing materials before eventually locating a combination that did not fail, all others having failed in one regard or the other. Only the particular combinations set-forth in this disclosure as the inventive combination obtain the above-noted objects sufficiently to be of any practical use and value. Some substantiating research is included in the detailed disclosure below.

THE FIGURES

DETAILED DESCRIPTION

With reference to FIGS. 1 through 3, and 1A, identical indicia are used for corresponding parts shown in different Figures, and similar indicia are used for corresponding parts of different embodiments.

Figure 1:
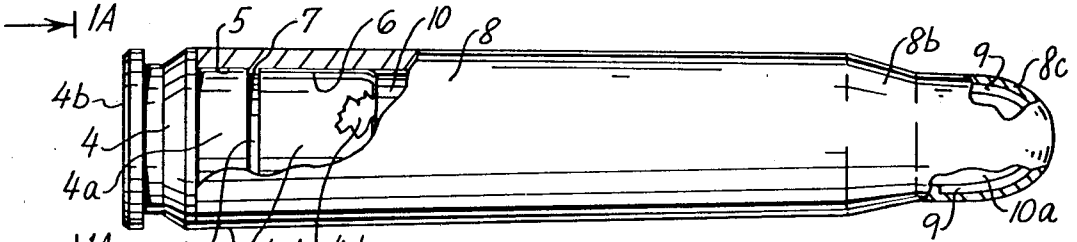
FIG. 1 illustrates the invention in the form of a novel cartridge-assembly in side view with partial cut-aways, as a cartridge blank.

FIG. 1 illustrates an entire cartridge assembly with its cartridge base 4 having a rearward end 4*b* and having a forward end 4*a*' and a central portion 4*a*, with the forward portion 4*a*' mounted in the envelope 8 by insertion within the envelope open-end 5 against inner-wall surface 6 from which extends flange 7 locking within recess (slot) 4*c* of the cartridge base, the annular slot 4*c* being within the circumscribing wall between wall portions 4*a* and 4*a*', the recess receiving the annular flange 7. The rear or lower end 8*a* of the envelope 8 has the open-end space 5 above-noted. At the distal end 8*b* of envelope 8 the wall 8*c* has undercut recesses or slots extending from the distal end 8*b* rearwardly or downwardly a predetermined distance shown toward the open-end portion 8*a*, the undercut recesses or slots 9 being shown in the partial cut-away. Space 10 is shown within the portion 8*a* of the envelope 8.

Figure 1A:
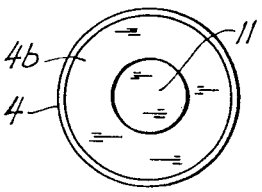
FIG. 1A illustrates an end-view of the embodiment of FIG. 1, as taken along lines 1A—1A of FIG. 1, with primer.

FIG. 1A illustrates a view of the FIG. 1 embodiment taken along lines 1A—1A, showing the cartridge-base portion 4*b* of the cartridge 4, and showing the mounted primer element 11.

Figure 2:
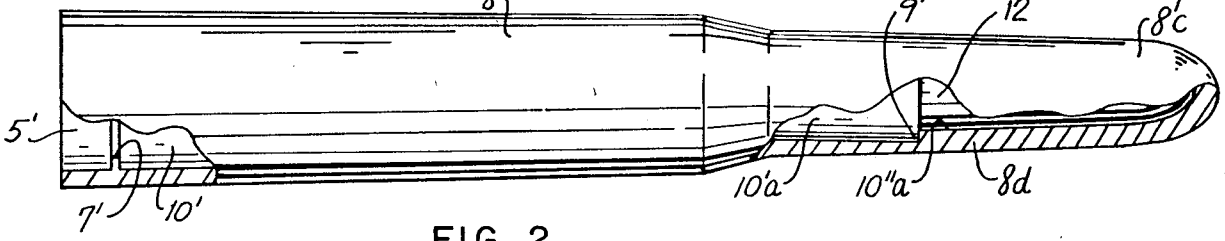
FIG. 2 illustrates the invention in the form of a novel envelope embodying a slug in the forward distal end thereof, in side view with partial cut-aways, which envelope is mountable on the cartridge-base shown in FIG. 1.

FIG. 2 illustrates another embodiment of the envelope as envelope 8', as a novel combination having a slug 12 mounted therein within space 10''*a* distally beyond space 10'*a* within the circumscribing wall 8*d* having undercut portions 9'. In the place of the bullet-slug 12, may be substituted one or more balls. The slug is of either metal or plastic, preferably plastic, and is typically solid but may have hollow portions therein and/or thereto. The bottom or lower portions of this envelope 8' correspond to the structure shown in the embodiment of FIG. 1, and receives the same cartridge-base as shown in FIG. 1.

Figure 3:
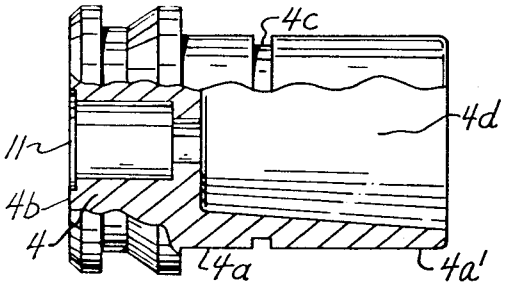
FIG. 3 illustrates the invention in the form of a novel cartridge-base in side view with partial cut-away and having mounted therein the primer, of the type shown in FIG. 1 and likewise of the type utilizable in combination with the envelope of the FIG. 2.

FIG. 3 illustrates alone the cartridge-base of FIG. 1 embodiment and that is utilizable as a novel combination with the envelope 8' of FIG. 2 embodiment, shown in side view with partial cut-away as cartridge-base 4 having above-noted portions 4*b*, 4*a*, 4*a*', and recess 4*c*, and having inner space 4*d*, with mounted primer element 11 mounted therein.

While no charge (explosive) has been illustrated within the space 4*d* of the cartridge-base nor in the envelopes, of the respective FIGS. 1, 2 and 3, because such is not the heart of the invention, it is to be understood that such explosive charge is naturally and obviously a part of any completed cartridge assembly.

Accordingly, FIG. 1 embodiment is illustrative of a cartridge blank assembly, while FIG. 2 illustrates an alternate embodiment carrying a metal or plastic slug(or bullet).

Dimensions, inner and outer, of the cartridge-base and of the envelope are variable within the scope and skill of the art, and for adaptation to different rifles, guns or pieces.

The term "slug" described-above as including either bullet or balls, is also intended within the scope of this invention to include any of armor-piercing projectile having space therein filled with an explosive, and/or tracer-bullets having space therein filled with tracer-resulting composition ignitable by firing of the tracer-bullet of conventional technology.

In the FIG. 2 embodiment, the circumscribing annular undercut wall portion 9' serves to cause the plastic-covered bullet to shear-off the plastic at the location of undercut wall portion 9', the plastic-coated slug/bullet/projectile thereafter rifling through the gun or rifle barrel.

The cartridge-base unit of intermixed and compressed, formed components has component amounts typically as follow:

polycarbonates—within a range of about 65% to 90%, preferably between about 70% and 80%, by weight;

polyethylene—within a range of about 15% to 30%, preferably between about 18% and 25% by weight;

polytetrafluoroethylene—within a range of about 1% to 10%, preferably between about 3% to 6% by weight.

The term "high density polyethylene" is a trade-accepted term meaning polyethylene of relatively high density such as at least about 0.955 Specific Gravity, as contrasted to low density typically of about 0.930 Specific Gravity.

Typical polycarbonates utilizable as the polycarbonates for the present invention as above-described, include for example the polycarbonates manufactured and sold by Mobay Chemical Corporation and the polycarbonates manufactured and sold by General Electric Company. The term "polycarbonate" is a generic term refering to polycarbonate polymer(s) falling into two categories as identified by Mobay Chemical Corporation, as Merlon T-95 resin as an opaque impact modified polycarbonate polymer offering excellent impact resistance in thick sections as well as at low temperatures, and as well good dimensional stability, mechanical strength and processing, the latter properties being also characteristic of unmodified Merlin polycarbonate. The Merlin T-95 resin also exhibits high notched Izod impact strength in thick sections (6.4 mm/0.25 inch) and a ductile failure mode during low temperature (−29 degrees C./−20 degrees F.) Gardner impact testing. A typical polycarbonate of General Electric Company utilizable within the present invention, is the Lexan Resins such as Lexan 2014, Lexan 940, Lexan 191 and the like.

Cartridge assemblies of this invention have typically been produced for and tested in the military piece(rifle) M2 successfully.

However, arriving at the particular components for the cartridge-base that would function properly with a particular shell(envelope) was determined solely after extensive testing of many diverse materials and combinations for each of the cartridge-base and the shell(envelope), of all tested solely the ones of this invention proving to be practically workable and acceptable. In making the determinations, some of the standards were as follow:

1. Must be compatible with explosive used.
2. Must be compatible with each other.
3. Must lend themselves to mass production.
4. Must be economical to produce.
5. Must function the weapon consistently without interference.
6. Must function in the weapon and be capable of ejecting on a repeatable frequency.
7. Must stand up to the temperatures and pressures of rapid fire without deterioration.
8. Must be impervious to environment found in storage and use of end product.

Materials selected and test molded in sample lots to include for the body were: polypropylene, polyester, and polyethylenes. Based on test results, the polyethylenes exhibited the most desirable characteristics of the group and have proven to meet design criteria.

Selection of base materials were made based on an estimate of those physical priperties required. Extensive testing was done with: polyethylene, polyester, polyphenylene oxide, polyphenylene sulfide, and polycarbonate. All of these materials were tested in filled and unfilled states, and the field was narrowed to polycarbonates; it was finally established that an impact modified polycarbonate with the added lubricity of Teflon (polytetrafluoroethylene) was required. Samples of Mobay Chemical T95 and General Electric M191 polycarbonates were finally certified for use in the invention, and the materials were fabricated and successful empirical firings were made. Various tests were generally made in M2 machine guns.

In a test utilizing polyester as the component from which the cartridge-base was made, with a Phillip's Chemical Co.- polyethylene cartridge-shell on a three-shot test the results were:

| | | | |
|---|---|---|---|
| #1 | High Score 700X without glue primer CCl-209M | 20 gr. charge | 1. At extraction separation of the base;<br>2. Shell stuck in the chamber;<br>3. Front part of the shell blew out (brittle fracture of material.) |
| #2 | High Score 700X with glue (Loctite) primer CCl-209M | 20 gr. charge | 1. Front of the shell blew out (brittle material)<br>2. Longitudinal split of the shell (3 inches long)<br>3. base rim sheared at extraction. |
| #3 | SS-4250 without glue primer IVI | 21 gr. charge | 1. Missfire due to movement of the primer pocket. |

Conclusion: Polyester base appear to be too brittle for the application.

In another set of tests utilizing single shot mode of firing, with a polyester shell(envelope), the base tested was molded from a compressed mixture of glass-filled polyester (black) bases, with CC1 209M primer, and propellant 4250SS (46 grains), using Loctite 430 as sealant glue, giving results that one of the five cartridges lost its primer during ejection cycle, and all five bases were seriously damaged—splits observed extending from primer pocket to outer diameter, and on all five bases the extractor finger sheared partially the rim of the base, and during firing fumes were coming out of the gun chamber through the breech. The conclusion: It appeared from this limited testing that the material of the base did not adequately resist to the pressure and a stronger material would be required (either plastic or metal). Due to the failure observed on the base material, no firings were made from linked cartridges as such test could have created hazards to personnel and equipment.

In another test, using polyethylene cases, the cartridge-base was made of polyphenylene sulfide 40% glass filled bases. Ten cartridge assemblies were tested. I.—During the first assembly test, two of the new bases crack during insertion of CC1 209M primers, whereupon the hole was drilled larger. II.—In the functioning test, the Weapon was a Machine gun 0.50 caliber M2 (with BFA), single-shot mode, with the results that for three test cartridges fired (Rounds 1, 2, and 3, all cartridges functioned the gun(recoiled the gun and self-extracted), but all three bases exhibited cracks extending from primer pocket to outer diameter, with fumes escaping from the cracks during firing. In a follow-up repeat for automatic firing for a belt of five cartridges, #4 to 8 inclusive, only the first cartridge fired, the second(#5) was not chambered automatically as the automatic feed mechanism seared its rim creata no-feed condition, and then on repeat, the third(#6) fired, and the last failed to be chambered(#7). Conclusion: The use of glass-filled polyphenylene sulfide for base material accompanied by resulting occurences of cracks at firing makes the material unsuitable for that type of cartridges, further evidence by breakage of the rim (at feed stage) in the automatic mode firing.

In a further set of tests utilizings separately as cartridge-bases, (1) Nylon, and (2) polyphenylene sulfide, and (3) Valox (polyester)—Nylon and Valox being trademarks; polyphenylene sulfide(Ryton/Trademark) and Nylon were found unsatisfactory, the polyphenylene base craking on single shot mode, and the Lexan having leaks observed at joint between base and case on single shot mode, and Nylon first-try—cracks observed on the base and second-try—failed to feed due to broken rim, on automatic-fire mode, and Lexon—first three fired automatically and fourth failed to feed. In these tests, all rounds were loaded with 46 grains of SS4250 powder, and primed with CC1-109 or primers.

In a further test, following the above-noted system of testing, using polyethylene shell(envelope(same as before), for Lexan-cartridge-base, #1 fired, #2 fired but did not totally eject and had a pierced-primer, #3 damaged due to malfunction of #2, #4 fired but base moved out of the shell, #5 fired, #6 fired but same as #2, #7 damaged by #6, #8 fired, #9 fired but same as #2 and 6, #7 damaged same as #3 and 7 using automatic firing mode; Nylon-cartridge-base, #1 fired, #2 fired but not ejected and pierced primer; #3 damaged by #2, #4 and 5 fired, #6 fired but same as #2, #7 damaged by #6, #8 same as #6, #9 fired. Accordingly, these bases and combinations thereof with the polyethylene shell(envelope) were found to be unsatisfactory.

These exempliary tests recited-above were disclosed as clear evidence of non-obviousness and of the presence of invention resulting in the present invention as set-forth in the preceding disclosure. Also, having flange 7 on the base failed in firing tests.

It is within the scope of this invention to make such variations and modifications and substitution of equivalents as would be obvious to a person of ordinary skill in this art.

Prior art patents turned-up in a patentability search and otherwise known to the inventor do not disclose any relevant information, but include the following.

L. Ringdal U.S. Pat. No. 2,918,868 granted Dec. 29, 1959 discloses a metal cartridge-base 2 and case (shell-/envelope) 8 within case (shell/envelope) 1, annular beads (flanges) 6 extending from the base 2, and thinned-walls score lines 9 at the apex(distal ends) of each of the envelopes 1 and 8, the envelopes 1 and 8 being of an elastic resin material such as polyethylene or polyvinylchloride.

L. Ringdal U.S. Pat. No. 2,862,446 granted Dec. 2, 1958 discloses a cartridge having a projectile 7 mounted in the nose of the envelope and extending out of it, the inner space of the case(envelope) being separate and isolated from the apex-mounting structure and space thereof, utilizing a metal base and an envelope(case) of polyethylene or polyvinylchloride.

J. T. Boutwell U.S. Pat. No. 3,144,827 granted Aug. 18, 1964 discloses a metal base and an envelope(case) 2 of polyvinyl acetate granules coated with polymerized sizing compound and a superjacent thermoplastic molding composition, and molded into the case(shell) shape, the thermoplastic being nylon/polyamides), having innerlines of thinned walls at the envelope(case)-tip also of reduced thickness at its apex.

Heinz Gawlick U.S. Pat. No. 3,882,778 granted May 13, 1975, discloses weakened envelope walls extending along lines longitudinally from the envelope's apex, the same generally as above-noted patents, having an envelope of thermoplastic synthetic resin such as polyethylene, polyvinyl chloride or the like and a cartridge-base not disclosed nor discussed, the outer envelope being mounted-on a metal powder-chamber 99.

J. W. Roske U.S. Pat. No. 2,654,319 granted Oct. 6, 1953, discloses a metal base 14 having a plastic envelope/shell 12 with a projectile tip 34 extending distally outwardly from a distal opening in the envelope that communicates with the envelope's main innerspace.

Lars Rindal U.S. Pat. No. 4,147,107 granted Apr. 3, 1979, discloses a metal cartridge-base having annular beads(flanges) 124 and envelope 14 (cartridge case of metal(drawing) composition mounted on sleeve 12 of thermoplastic such as polyolefins as high density polyethylene, polypropylene, polyamides, polyacetals, polyesters, which sleeve 12 is mounted on the base(bottom plate) 27. Also, a projectile's upper portion 511 protrudes from the plastic case 57 that may be made of thermoplastic material.

Lawrence E. Boquette, Jr. U.S. Pat. No. 3,935,816 granted Feb. 3, 1976 discloses a continuous cartridge base and envelope of plastic such as acrylonitrile, butadiene, styrene, polyamide, polycarbonate, polyethylene, polypropylene and vinyl unitarily molded around a solid charge and primer thereto, and having a lead or lead-impregnated vinyl insert 4 within the molded-plastic with break-away weakened-wall (thinner) points 8.

Other prior art appears to be merely cummulative.

I claim:

1. A cartridge assembly including a cartridge-base having mounted thereon a plastic envelope, said cartridge-base comprising polycarbonate in a range of about 65% by weight to about 90% by weight and polyethylene in an amount in a range of from about 15% by weight top about 30% by weight admixed and compressed as a unit, shaped as a cartridge-base, and said plastic envelope comprising a major amount of high-density polyethylene, said major amount being sufficient to impart reliable durability to the envelope when subjected to firing, said plastic envelope having a bottom open-end of inside diameter of predetermined dimension such that the plastic envelope receives and mounts a forward end of the cartridge-base within said bottom open-end, and a slug mounted within said plastic envelope.

2. A cartridge assembly of claim 1, in which said cartridge-base includes a minor amount of polytetrafluoroethylene admixed with said polycarbonate and said polyethylene and compressed therewith as a part of said cartridge-base, said minor amount being sufficient to impart lubricity to the polycarbonate.

3. A cartridge assembly of claim 2, in which said plastic envelope at said lower open-end has an inner-wall surface having a circumscribing annular flange, and in which said cartridge-base has a forward-end outer-wall surface having a circumscribing annular recess mounted on said annular flange.

4. A cartridge assembly of claim 2, in which said plastic envelope comprising walls circumscribing said slug and said circumscribing walls at a base of the slug being undercut to a thinner thickness such that the plastic-encased slug is facilitated in a break-away of encasing plastic at the undercut when the cartridge assembly is fired.

5. A cartridge assembly of claim 2, in which said polytetrafluoroethylene ranges from about 1% to about 10% by weight.

* * * * *